US007604140B2

(12) United States Patent
Pritchett, Jr. et al.

(10) Patent No.: US 7,604,140 B2
(45) Date of Patent: Oct. 20, 2009

(54) MULTI-SIDED SPIRALED PLASTIC CONTAINER

(75) Inventors: Raymond A. Pritchett, Jr., Red Lion, PA (US); Angie Noll, York, PA (US); Scott Bysick, Lancaster, PA (US)

(73) Assignee: Graham Packaging Company, L.P., York, PA (US)

( * ) Notice: Subject to any disclaimer, the term of this patent is extended or adjusted under 35 U.S.C. 154(b) by 496 days.

(21) Appl. No.: 11/292,283

(22) Filed: Dec. 2, 2005

(65) Prior Publication Data

US 2007/0125743 A1 Jun. 7, 2007

(51) Int. Cl.
*B65D 1/40* (2006.01)
*B65D 1/42* (2006.01)

(52) U.S. Cl. ..... 215/381; 220/675

(58) Field of Classification Search ..... 215/381, 215/382, 379, 900; 220/675, 666, 669
See application file for complete search history.

(56) References Cited

U.S. PATENT DOCUMENTS 5,472,105 A 12/1995 Krishnakumar et al.
5,593,056 A * 1/1997 Mero et al. ..... 215/382
5,704,503 A 1/1998 Krishnakumar et al.
5,704,504 A * 1/1998 Bueno ..... 215/381
5,908,126 A 6/1999 Wang
5,971,184 A 10/1999 Krishnakumar et al.
D415,964 S 11/1999 Manderfield, Jr. et al.
6,044,996 A 4/2000 Carew et al.
D430,493 S 9/2000 Weick
6,520,362 B2 * 2/2003 Heisel et al. ..... 215/381
6,763,969 B1 * 7/2004 Melrose et al. ..... 220/669
2005/0263481 A1 * 12/2005 Tanaka et al. ..... 215/381
2006/0289378 A1 * 12/2006 Zhang ..... 215/381
2007/0007234 A1 * 1/2007 Tanaka et al. ..... 215/381

FOREIGN PATENT DOCUMENTS

JP 56-658031 10/1981
JP 2005212871 A * 8/2005

* cited by examiner

*Primary Examiner*—Sue A. Weaver
(74) *Attorney, Agent, or Firm*—Knoble Yoshida & Dunleavy, LLC

(57) ABSTRACT

A multi-sided spiraled plastic container for liquid, flowable, and squeezable products may be suitable for use with food or beverage products packaged by traditional hot-fill processes. The container includes an open top through which the container is adapted to be filled, and a body portion having a shoulder section, which extends downwardly from the open top towards a closed base portion. The body portion has a plurality of vacuum panel pairs which are disposed in a spiral fashion about the body portion and configured for contributing to a superior top load strength of the container.

16 Claims, 4 Drawing Sheets

MULTI-SIDED SPIRALED PLASTIC CONTAINER

BACKGROUND OF THE INVENTION

The present invention is related generally to blow molded plastic containers for liquid, flowable, and squeezable products, and more particularly to stretch blow molded containers that may be suitable for use with food or beverage products packaged by traditional hot-fill processes.

Many food and beverage products are sold to the consuming public in plastic containers, such as those that are shown in U.S. Pat. No. 5,472,105 (Krishnakumar et al.), U.S. Pat. No. 5,704,503 (Krishnakumar et al.), and U.S. Pat. No. 5,971,184 (Krishnakumar et al.). The design of such containers must take into account the container's structural integrity, the manufacturing cost to mass-produce the container, and the aesthetic appearance of the container to the eye of the consumer.

Hot-fillable plastic beverage containers such as those disclosed in the above referenced patents must be structurally sound to withstand various forces relating to the so-called "hot-fill" process. In a hot fill process, a product is first added to the container at an elevated temperature (e.g., about 82° C.), which may be near the glass transition temperature of the plastic material. Then, the container is capped. As the capped container and its contents cool, the contents tend to contract leading to a volumetric change, which creates a partial vacuum within the container. In the absence of some means for accommodating these internal volumetric and barometric changes, containers tend to deform and/or collapse. For example, a round container may undergo ovalization, or tend to distort and become out of round. Containers of other shapes may become similarly distorted. In addition to these changes that adversely affect the appearance of the container, distortion or deformation may cause the container to lean or become unstable. This may be particularly true where deformation of the base region occurs.

Containers that store products under pressure, such as carbonated beverages, also experience pressure changes due to changes in ambient temperature. A commercially satisfactory container must not only withstand these forces from a structural viewpoint, but it must also present an aesthetically pleasing appearance to the ultimate consumer. Moreover, it must withstand rough handling during transportation to that consumer.

The price of many products sold to the consuming public is affected to an extent by the cost of packaging. With plastic beverage containers, the cost of manufacturing a container is affected by the cost of the plastic making up the container. Therefore, if the amount of plastic in a container can be reduced (i.e., through a process known as "light weighting"), the cost of manufacturing the container may be reduced commensurately. In achieving this goal, however, it is known that the thinner the walls and base of the container become, the greater the need is to utilize imaginative designs to provide a container that is commercially acceptable.

The desire to decrease the amount of plastic used in a container has resulted in the development of different techniques to design containers that have structural integrity with minimal use of plastic. It is known that the shape and location of structural elements such as ribs, hinges, panels, and the like may affect the container's overall structural integrity. While various structural elements molded in the side panel and base structure may afford structural integrity, they must also be visually appealing to the consumer.

The Krishnakumar et al. '105 patent noted above discloses a hot-fillable plastic container having a panel section with vacuum panels and an end grip, which panel section resists ovalization and other deformation during filling, product cooling, and handling. The container has a substantially cylindrical panel section, with a pair of vertically elongated vacuum panels disposed on opposing sides of a vertical plane passing through a vertical centerline of the container. Front and rear label attachment areas are provided between the vacuum panels. A pair of vertical ribs are disposed on either side of each vacuum panel which act as hinge points to maximize movement of a concave recess in the vacuum panel; the vertical ribs also resist longitudinal bending. The concave recess is formed at an initial inwardly-bowed position with respect to the panel circumference, and is movable outwardly to a second position within the panel circumference upon increased pressure during filling, and movable inwardly to a third position to accommodate the vacuum which forms during product cooling.

The Krishnakumar et al. '503 patent noted above discloses a panel design for a hot-fillable plastic container, which has a tall and slender panel section. The panel configuration provides increased resistance to longitudinal bending and hoop failure, yet provides good hoop flexibility to maximize vacuum panel movement. The panel section has a substantially cylindrical circumference with a plurality of vacuum panels symmetrically disposed about the panel circumference, post walls between the vacuum panels, and land areas above and below the vacuum panels. The ratio of vacuum panel height D to panel diameter C is on the order of 0.85 to 1.05. Longitudinal post ribs are provided in the post walls. The land areas above and below the vacuum panels are of a height E greater than on the order of 0.45 inch, and the ratio of the land area height E to panel diameter C is on the order of greater than 0.1. Circumferential hoop ribs are provided in the land areas to prevent ovalization and hoop collapse.

The Krishnakumar et al. '184 patent noted above discloses a hot-fillable plastic container having a panel section of a size suitable for gripping the container in one hand. The panel section includes two opposing vertically-elongated and radially-indented vacuum panels, and two opposing horizontally-disposed and radially-indented finger grips. Each vacuum panel preferably has an invertible central wall portion movable from a convex first position prior to hot-filling of the container, to a concave second position under vacuum pressure following hot-filling and sealing of the container.

Containers such as those disclosed in the above-referenced Krishnakumar et al. patents are typically formed with an even number—especially six—vacuum panels, which are symmetrically disposed about a longitudinal axis of the container. Other means for resisting ovalization and similar such deformation, which use an odd number of vacuum panels, are also known in the prior art. For example, Japanese Laid Open Utility Model Registration No. 56-658031 discloses a hot fill container, which has a base, a body, and a neck. The body includes a plurality of spaced-apart vertical lands and an odd number of spaced-apart panels. Finally, it discloses that a container having the odd number of panels may resist deformation forces caused by pressure reduction in the bottle because those panels are not disposed about the longitudinal axis of the container in a diametrically opposed relationship.

U.S. Pat. No. 6,044,996 (Carew et al.) also discloses a hot-fill container formed from a polymeric material comprising a base, a body, and a neck, wherein the body comprises an odd number of spaced-apart panels that are responsive to internal pressure changes in the container. According to the Carew et al. '996 patent, hot-fill bottles of a given capacity having an uneven number of deformable panels (e.g., five) of a given wall thickness unexpectedly accommodate significantly higher volume reductions before collapsing and distorting in an uncontrolled manner than known hot-fill bottles of the same capacity having an even number of panels (e.g., six) of the same wall thickness.

Notwithstanding the contributions of the foregoing prior art, neither an odd nor an even number of panels alone may satisfy the problems of ovalization and deformation, which may be faced by plastic beverage containers that also must present an aesthetically pleasing appearance to the ultimate consumer.

The Institute of Packaging Professionals (IoPP), for example, announced its 1999 AmeriStar award winners at the 1999 AmeriStar Package Awards during WestPack in November 1999. There were three award winners in the food category, including Graham Packaging's Tropicana Twister® (a registered trademark of Tropicana Products, Inc., 1001 13th Avenue, East Bradenton Fla. 33506 U.S.A.) plastic bottle design. The bottle won due to its distinctive shape, broad label panel and unique design that enhances shelf appeal and product quality.

The illustrated preferred embodiment of that bottle design included two generally parallel diagonal ribs 42, as well as an offset rib 43 having both a generally horizontal leg 44 and a diagonal leg 45 which is generally parallel to the diagonal ribs 42. These ribs minimized the need for special handling with respect to vacuum conditions for a hot-filled product. It did not, however, depend upon uniquely designed vacuum panels. See, e.g., U.S. Pat. No. 5,908,126 (Weick et al.) and U.S. Pat. No. Des. 415,964 (Manderfield, Jr. et al.)

Judges for the IoPP described the bottle as a breakthrough in the juice industry because it embodied " . . . a distinctive shape, broad label panel and unique design to enhance shelf appeal and product quality." The bottle also went on to win a WorldStar Award, which is considered the pre-eminent international award sponsored by the World Packaging Organisation in packaging and is only given to products that have won recognition in a national competition.

Although the aforementioned containers may function satisfactorily for their intended purposes, there remains a continuing need for a blow molded plastic container having vacuum panels, which enhance the structural integrity of the container while requiring a minimum use of plastic. Also, these vacuum panels need to be aesthetically pleasing and be capable of being manufactured in conventional high-speed equipment.

BRIEF DESCRIPTION OF THE DRAWINGS

The foregoing and other features and advantages of the invention will be apparent from the following, more particular description of embodiments of the present invention, as illustrated in the accompanying drawings wherein like reference numbers generally indicate identical, functionally similar, and/or structurally similar elements.

DETAILED DESCRIPTION OF PREFERRED EMBODIMENTS

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations may be used without parting from the spirit and scope of the invention. All references cited herein are incorporated by reference as if each had been individually incorporated.

Figure 1:
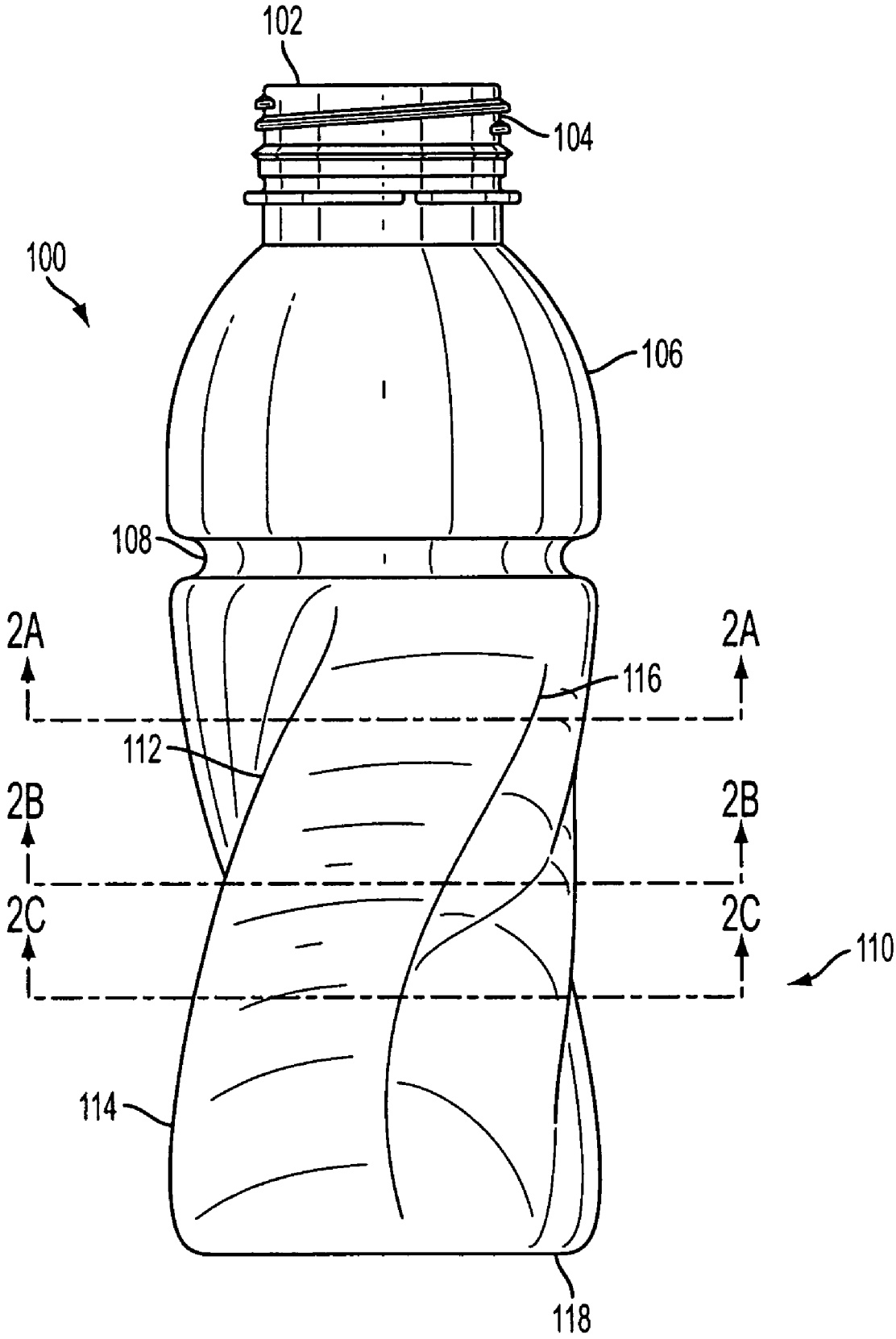
FIG. 1 depicts a front view of the container according to embodiments of the present invention.

As shown in FIG. 1 and throughout, it should be understood that container 100 may be used to package a wide variety of liquid, viscous or solid products including, for example, juices, other beverages, yogurt, sauces, pudding, lotions, soaps in liquid or gel form, and bead shaped objects such as candy.

Moreover, it may be appreciated that container 100 may have a one-piece construction and may be prepared from a monolayer plastic material, such as a polyamide, for example, nylon; a polyolefin such as polyethylene, for example, low density polyethylene (LDPE) or high density polyethylene (HDPE), or polypropylene; a polyester, for example polyethylene terephthalate (PET), polyethylene naphtalate (PEN); or others, which may also include additives to vary the physical or chemical properties of the material. For example, some plastic resins may be modified to improve the oxygen permeability. Alternatively, the container may be prepared from a multilayer plastic material. The layers may be any plastic material, including virgin, recycled and reground material, and may include plastics or other materials with additives to improve physical properties of the container. In addition to the above-mentioned materials, other materials often used in multilayer plastic containers include, for example, ethylvinyl alcohol (EVOH) and tie layers or binders to hold together materials that are subject to delamination when used in adjacent layers. A coating may be applied over the monolayer or multilayer material, for example to introduce oxygen barrier properties. In an exemplary embodiment, the present container is prepared from PET.

Container 100 should be able to withstand the rigors of hot-fill processing. In a hot-fill process, a product is added to container 100 at an elevated temperature (i.e., about 82° C.), which may be near the glass transition temperature of the plastic material, and the container is capped. As container 100 and its contents cool, the contents tend to contract and this volumetric change creates a partial vacuum within the container. In the absence of some means for accommodating these internal volumetric and barometric changes, containers tend to deform and/or collapse. For example, a round container may undergo ovalization, or tend to distort and become out of round. Containers of other shapes may become similarly distorted. In addition to these changes that may adversely affect the appearance of container 100, distortion or deformation may cause container 100 to lean or become unstable.

As a result, container 100 may be made by conventional blow molding processes including, for example, extrusion blow molding, stretch blow molding and injection blow molding.

For example, with extrusion blow molding, a molten tube of thermoplastic material, or plastic parison, is extruded between a pair of open blow mold halves. The blow mold halves close about the parison and cooperate to provide a cavity into which the parison is blown to form the container. As so formed, container 100 may include extra material, or flash, at the region where the molds come together, or extra material, or a moil, intentionally present above the container finish. After the mold halves open, the container 100 drops out and is then went to a trimmer or cutter where any flash of moil is removed. The finished container 100 may have a visible ridge (not shown) formed where the two mold halves used to form the container came together. This ridge is often referred to as the parting line.

With stretch blow molding, for example, a preformed parison, or perform, is prepared from a thermoplastic material, typically by an injection molding process. The perform typically includes an opened, threaded end 102, which becomes the threads 104 of container 100. The perform is positioned between two open blow mold halves. The blow mold halves close about the perform and cooperate to provide a cavity into which the preform is blown to form the container. After molding, the mold halves open to release the container 100. For wide mouth containers, the container 100 may then be sent to a trimmer where the moil, or extra plastic material above the blown finish, is removed.

With injection blow molding, a thermoplastic material may be extruded through a rod into an inject mold to form a parison. The parison is then positioned between two open blow mold halves. The blow mold halves close about the parison and cooperate to provide a cavity into which the parison may be blown to form the container 100. After molding, the mold halves open to release the container.

Figure 2A:
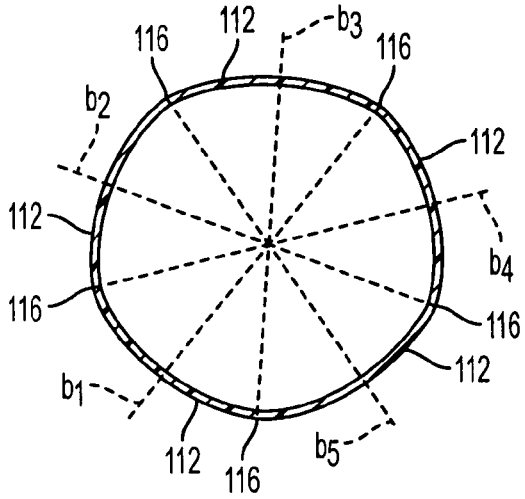
FIG. 2A depicts a cross-sectional view of the container of FIG. 1, as taken along the lines 2A-2A.
Figure 2B:
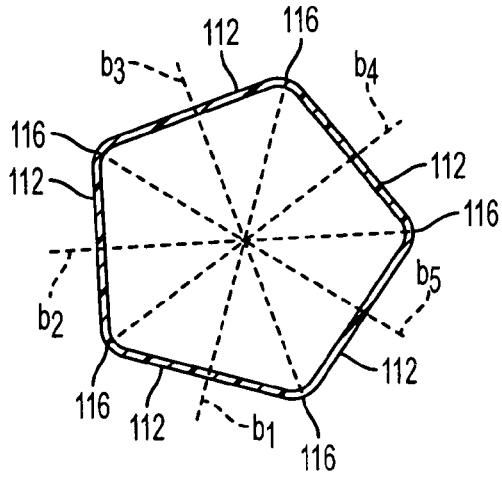
FIG. 2B depicts a cross-sectional view of the container of FIG. 1, as taken along the lines 2B-2B.
Figure 2C:
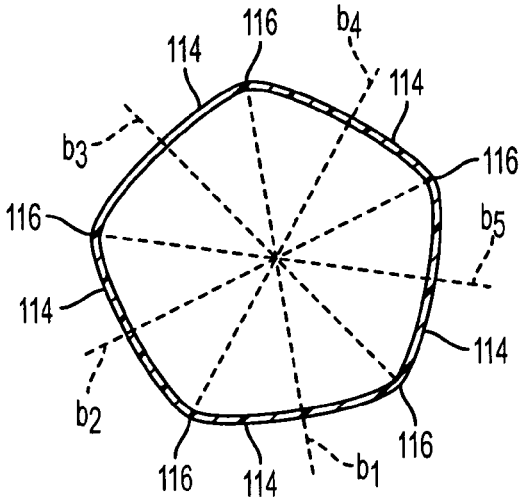
FIG. 2C depicts a cross-sectional view of the container of FIG. 1, as taken along the lines 2C-2C.
Figure 3:
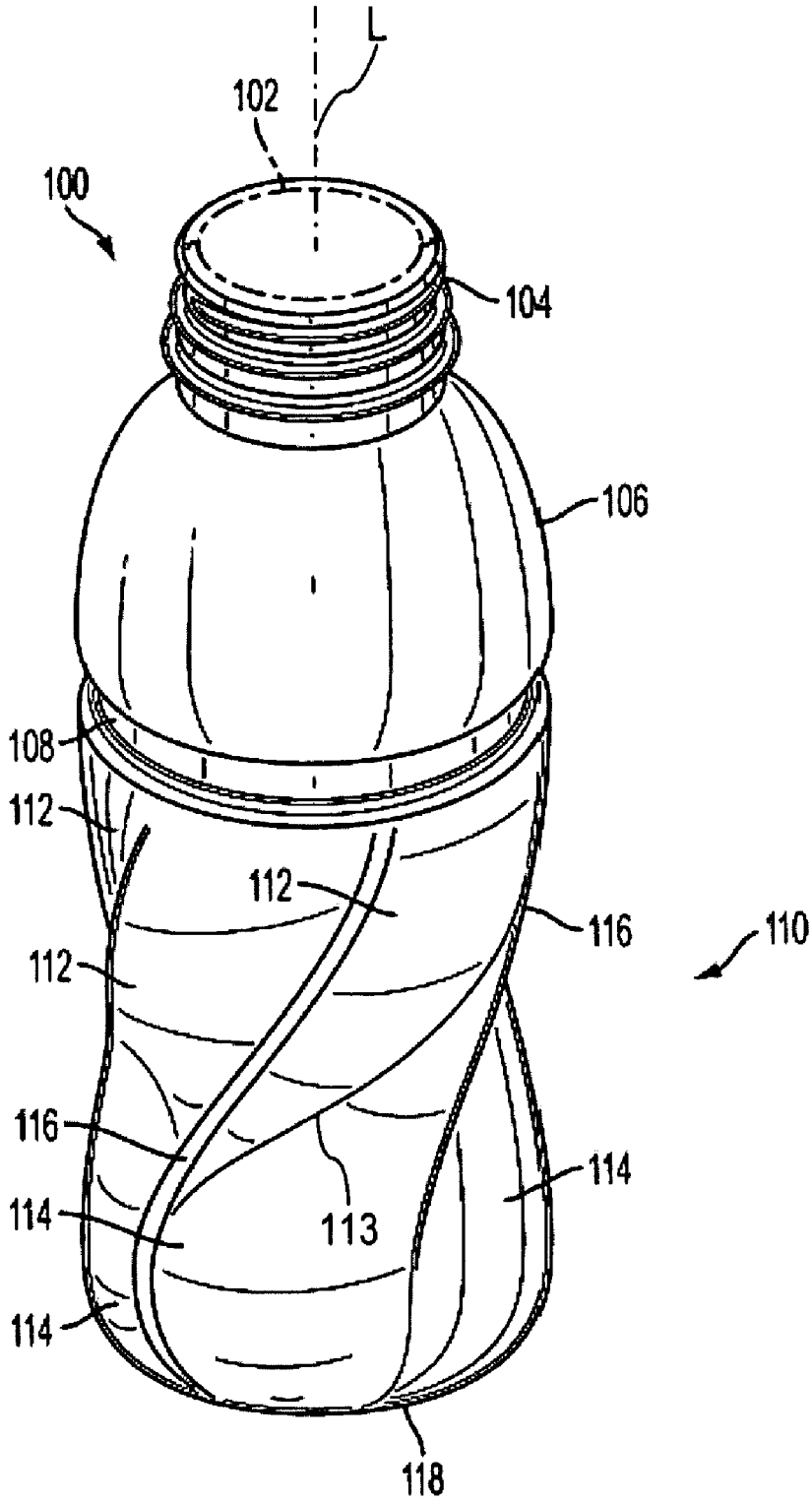
FIG. 3 depicts a perspective view of the container shown in FIG. 1, as viewed from above.

The sidewall, as formed, is substantially tubular and may have any cross-sectional shape. Cross-sectional shapes include, for example, a generally circular transverse cross section (e.g., as illustrated in FIG. 2A), an oval transverse cross section; a substantially square transverse cross-section; other substantially polygonal transverse cross-sectional shapes such as triangular, pentagonal (e.g., as illustrated in FIGS. 2B and 2C), etc.; or combinations of curved and arced shapes with linear shapes. As will be understood, when the container 100 has a substantially polygonal transverse cross-sectional shape, the corners of the polygon may be typically rounded or chamfered.

Plastic blow-molded containers, particularly those molded of PET, have been utilized in hot-fill applications where the container 100 is filled with a liquid product heated to a temperature in excess of 180° F. (i.e., 82° C.), capped immediately after filling, and allowed to cool to ambient temperatures. Plastic blow-molded containers have also been utilized in pasteurization and retort processes, where a filled and sealed container is subjected to thermal processing and is then cooled to ambient temperatures. Pasteurization and retort methods may be frequently used for sterilizing solid or semi-solid food products, e.g., pickles and sauerkraut, which may be packed into the container 100 along with a liquid at a temperature less than 82° C. (i.e., 180° F.) and then heated, or the product placed in the container 100 that is then filled with liquid, which may have been previously heated, and the entire contents subsequently heated to a higher temperature.

Pasteurization and retort differ from hot-fill processing by including heating the contents of a filled container to a specified temperature, typically greater than 93° C. (i.e., 200 F), until the contents reach a specified temperature, for example 80° C. (i.e., 175° F.), for a predetermined length of time. Retort processes also involve applying overpressure to the container 100. It should, nevertheless, be understood that container 100 may be used in any such packaging process, including but not limited to known aseptic, cold-fill, hot-fill, pasteurization, and retort processes.

According to a first embodiment of the present invention as depicted in FIG. 1, container 100 generally comprises an opening 102 at one end, which includes a threaded finish 104, a bell-shaped dome portion 106 beneath the finish 104, an annular rib 108 which separates the dome portion 106 from a body portion 110, and a base portion 118 at the other, closed end of the container 100.

Between the annular, inwardly-projecting rib 108 and the base 118 are a plurality of vacuum panels 112, 114, which spiral or twist about the longitudinal axis of container 100 in order to provide an aesthetically pleasing, yet strongly branded appearance. As shown particularly in FIGS. 1, 2A-2C, and 3, an upper vacuum panel portion 112 transitions smoothly into a lower vacuum portion 114. Corresponding pairs of such upper 112 and lower 114 vacuum panel portions are conveniently separated for maximum efficiency by a relatively rigid transitional wall 116.

In the embodiment shown in FIGS. 1, 2A-2C, and 3, container 100 may be formed with an odd number of generally vertically disposed vacuum panel pairs 112, 114, such that the transitional wall 116 at any given point about the periphery of container 100 is diametrically opposed to the midpoint $b_1$, $b_2$, $b_3$, $b_4$, $b_5$ of a vacuum panel 112, 114 on the other side of container 100. Container 100 may, thereby, withstand the volumetric and barometric changes, which are generally associated with hot-fill packaging processes.

The upper and lower vacuum panels 112, 114 in this embodiment spiral or twist about the longitudinal axis of container 100 at about 72 degrees. That is, for the five-sided container 100 shown in FIGS. 1, 2A-2C, and 3, such vacuum panel pairs 112, 114 would spiral or twist at about 36 degrees in a first direction to a midpoint of the container 100 and about 36 degrees in a second direction to the base portion 118 of the container 100.

In a similar manner for a four-sided container, the upper and lower vacuum panels would spiral or twist about the longitudinal axis of that container at about 90 degrees. Such vacuum panel pairs would spiral or twist at about 45 degrees in a first direction to a midpoint of that container and about 45 degrees in a second direction to the base portion of that container.

Likewise for a six-sided container, the upper and lower vacuum panels would spiral or twist about the longitudinal axis of that container at about 60 degrees. Such vacuum panel pairs would spiral or twist at about 30 degrees in a first direction to a midpoint of that container and about 30 degrees in a second direction to the base portion of that container.

In a similar manner for a seven-sided container, the upper and lower vacuum panels would spiral or twist about the longitudinal axis of that container at about 52 degrees. Such vacuum panel pairs would spiral or twist at about 26 degrees in a first direction to a midpoint of that container and about 26 degrees in a second direction to the base portion of that container.

Likewise for an eight-sided container, the upper and lower vacuum panels would spiral or twist about the longitudinal axis of that container at about 45 degrees. Such vacuum panel pairs would spiral or twist at about 22-23 degrees in a first direction to a midpoint of that container and about 22-23 degrees in a second direction to the base portion of that container.

Unlike conventional vacuum panels, the upper 112 and lower 114 vacuum panel portions of container 100 are spiraled or twisted, and may be curved radially outwardly with respect to the longitudinal axis. The radius of curvature of each upper vacuum panel portion 112 may generally increase as it progresses in a downward direction towards the base 118 of container 100. In such a manner, any given upper vacuum panel portion 112 transitions into its corresponding lower vacuum panel portion 114 with a substantially infinite radius of curvature (i.e., making that line of transition—113 in FIG. 3—essentially flat). The radius of curvature of the lower vacuum panel portion 114 from such essentially flat line of transition then decreases towards the base 118 of container 100.

Each panel 112, 114 may suitably comprise any highly efficient vacuum panel. One suitable such form of vacuum panel is disclosed in WO 00/50309 (Melrose), where a container comprising controlled deflection flex panels has initiator portions that may invert and flex under pressure to avoid deformation and permanent buckling.

Figure 4:
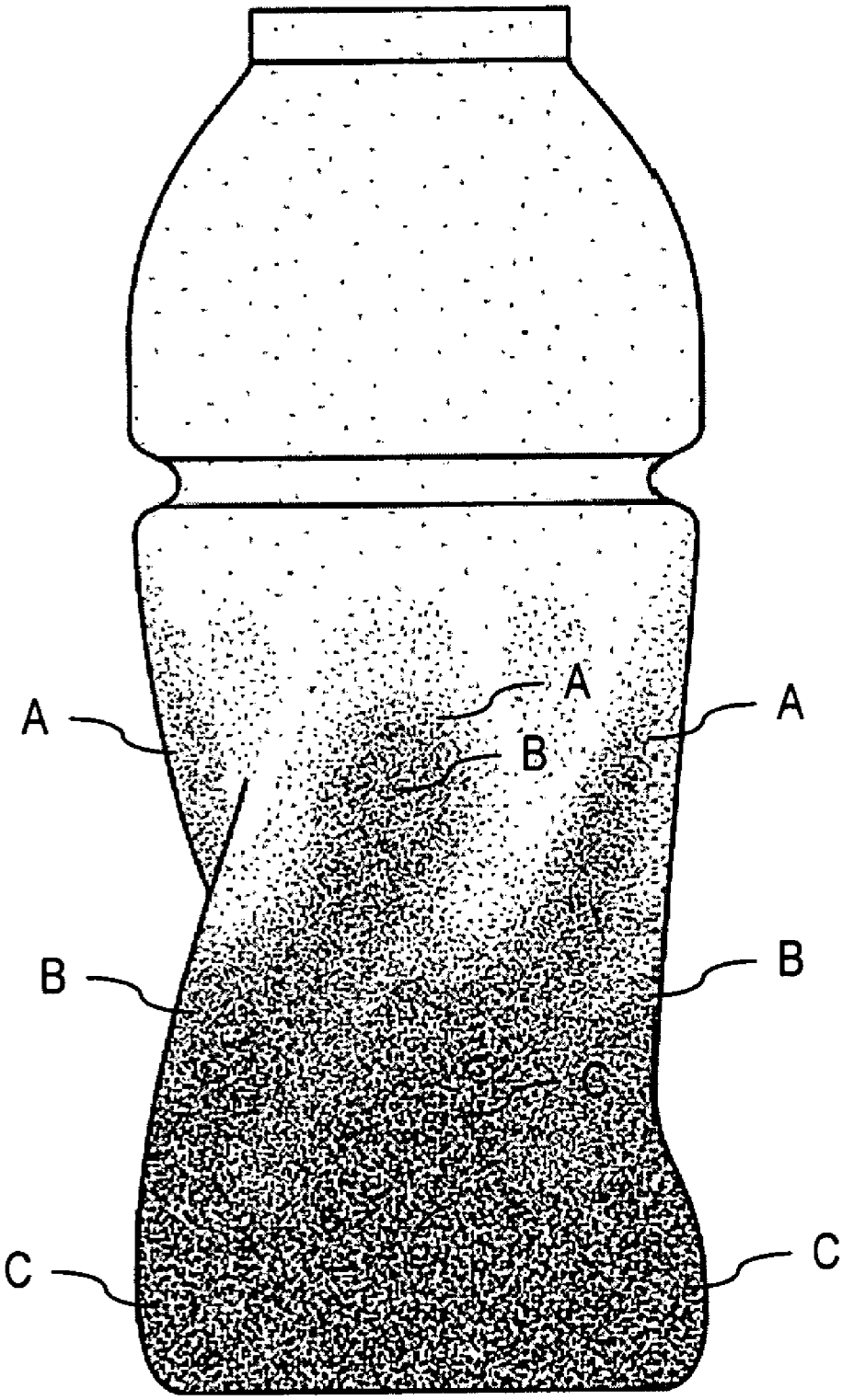
FIG. 4 depicts a finite element analysis (FEA) of the container shown in FIG. 1 under a vacuum of about 2.25 pounds per square inch (PSI).

FIG. 4 depicts an FEA of container 100 according to embodiments of the present invention. As shown therein, stippling of a greater density illustrates areas of greater inward deflection caused by vacuum uptake during a conventional hot-filling, capping, and cooling process. The maximum amount of deflection shown in FIG. 4 is approximately 4.14 mm (i.e., 0.163 in.) at about 2.25 PSI. Of particular note, it can be seen that the upper 112 and lower 114 vacuum panel portions of container 100 distribute the volumetric and barometric forces imposed by such process in a substantially uniform manner. See, e.g., regions A, B, and C.

As compared to the base, lines of transition, and panel portions, regions A experience a relatively smaller amount of inward deflection—on the order of about 2.29 to 2.84 mm (i.e., 0.090 to 0.110 in.). Regions B are exemplary of the lines of transition and panel portions, which experience a relatively greater amount of inward deflection—on the order of about 3.05 to 3.30 mm (i.e., 0.120 to 0.130 in.). Finally, regions C in the base experience the greatest amount of inward deflection—on the order of about 3.30 to 4.14 mm (i.e., 0.130 to 0.163 in.). The dome portion 106, annular ring 108, and portions of the upper 112 vacuum panel portion proximate to the annular ring 108 experience little or no inward deflection. This uniform distribution of forces, in turn, is caused by the radial and longitudinal disposition of the upper 112 and lower 114 vacuum panel portions in the manner shown in FIGS. 1, 2A-2C, and 3.

Accordingly, containers 100 according to embodiments of the present invention resist deformation and/or collapse. They generally do not undergo any substantial ovalization, nor do they tend to distort and become out of round. Container 100 as shown includes five upper 112 and lower 114 vacuum panel pairs. However, a container having any odd or even number of upper 112 and lower 114 vacuum panel pairs may similarly resist deformation and/or collapse.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It may therefore be understood that, within the scope of the claims and their equivalents, the invention may be practiced otherwise than as specifically described.

What is claimed is:

1. A polymeric container, comprising:

an open top through which the polymeric container is adapted to be filled;

a body portion having a shoulder section, which extends downwardly from said open top towards a closed base portion;

said body portion having a plurality of vacuum panel pairs which are disposed in a spiral fashion about said body portion and configured for contributing to a superior top load strength of the polymeric container, wherein each vacuum panel of said plurality of vacuum panel pairs comprises an outward curve;

wherein said vacuum panel pairs spiral in a first direction to a midpoint of the container and in a second direction to said base portion of the container; and a relatively rigid transitional wall between adjacent vacuum panel pairs, wherein each vacuum panel midpoint is diametrically opposed to a corresponding transitional wall.

2. The polymeric container according to claim 1, wherein said vacuum panel pairs spiral at about 72 degrees.

3. The polymeric container according to claim 2 wherein said vacuum panel pairs spiral at about 36 degrees in the first direction and about 36 degrees in the second direction.

4. The polymeric container according to claim 3, wherein said first and second direction are opposite.

5. The polymeric container according to claim 1, wherein said vacuum panel pairs spiral at about 90 degrees.

6. The polymeric container according to claim 5 wherein said vacuum panel pairs spiral at about 45 degrees in the first direction and about 45 degrees in the second direction.

7. The polymeric container according to claim 1, wherein said vacuum panel pairs spiral at about 60 degrees.

8. The polymeric container according to claim 7 wherein said vacuum panel pairs spiral at about 30 degrees in the first direction and about 30 degrees in the second direction.

9. The polymeric container according to claim 1, wherein said vacuum panel pairs spiral at about 52 degrees.

10. The polymeric container according to claim 9 wherein said vacuum panel pairs spiral at about 26 degrees in the first direction and about 26 degrees in the second direction.

11. The polymeric container according to claim 1, wherein said vacuum panel pairs spiral at about 45 degrees.

12. The polymeric container according to claim 11 wherein said vacuum panel pairs spiral at about 22 to 23 degrees in the first direction and about 22 to 23 degrees in the second direction.

13. The polymeric container according to claim 1, comprising an odd number of vacuum panel pairs.

14. The polymeric container according to claim 13, comprising five vacuum panel pairs.

15. A polymeric container, comprising:

an open top through which the polymeric container is adapted to be filled;

a body portion having a shoulder section, which extends downwardly from said open top towards a closed base portion;

said body portion having:

a plurality of vacuum panel pairs which are disposed in a spiral fashion about said body portion, wherein each vacuum panel of said plurality of vacuum panel pairs comprises an outward curve; and a relatively rigid transitional wall between adjacent vacuum panel pairs, wherein each vacuum panel midpoint is diametrically opposed to a corresponding transitional wall; and wherein said vacuum panel pairs spiral in a first direction to a midpoint of the container and in a second direction to said base portion of the container.

16. A polymeric container, comprising:

an open top through which the polymeric container is adapted to be filled;

a body portion having a shoulder section, which extends downwardly from said open top towards a closed base portion;

said body portion having:

an odd number of vacuum panel pairs which are disposed in a spiral fashion about said body portion, wherein each vacuum panel of said plurality of vacuum panel pairs comprises an outward curve; and a relatively rigid transitional wall between adjacent vacuum panel pairs, wherein each vacuum panel midpoint is diametrically opposed to a corresponding transitional wall;

wherein said vacuum panel pairs spiral in a first direction to a midpoint of the container and in a second direction to said base portion of the container.

* * * * *

UNITED STATES PATENT AND TRADEMARK OFFICE

CERTIFICATE OF CORRECTION

PATENT NO. : 7,604,140 B2
APPLICATION NO. : 11/292283
DATED : October 20, 2009
INVENTOR(S) : Pritchett, Jr. et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 818 days.

Signed and Sealed this

Fifth Day of October, 2010

David J. Kappos

David J. Kappos
*Director of the United States Patent and Trademark Office*